US008898879B2

(12) United States Patent
Hussmann

(10) Patent No.: US 8,898,879 B2
(45) Date of Patent: Dec. 2, 2014

(54) RANDOM TILE INSTALLATION USING NON-RANDOM INSTALLATION TECHNIQUE

(75) Inventor: Glen Hussmann, Chattanooga, TN (US)

(73) Assignee: Tandus Flooring, Inc., Dalton, GA (US)

( * ) Notice: Subject to any disclaimer, the term of this patent is extended or adjusted under 35 U.S.C. 154(b) by 177 days.

(21) Appl. No.: 13/297,724

(22) Filed: Nov. 16, 2011

(65) Prior Publication Data

US 2012/0110804 A1 May 10, 2012

Related U.S. Application Data

(63) Continuation of application No. PCT/US2010/036382, filed on May 27, 2010.

(60) Provisional application No. 61/182,807, filed on Jun. 1, 2009.

(51) Int. Cl.
*B21D 39/03* (2006.01)
*A47G 27/02* (2006.01)
*A47G 27/04* (2006.01)

(52) U.S. Cl.
CPC ..... *A47G 27/0475* (2013.01); *A47G 27/0275* (2013.01)
USPC ..... 29/428; 28/100; 428/85

(58) Field of Classification Search
USPC ..... 28/100, 289, 299; 29/248, 428
See application file for complete search history.

(56) References Cited

U.S. PATENT DOCUMENTS 3,704,197 A * 11/1972 Bahlo ..... 428/85
3,866,267 A 2/1975 Poletti
3,875,716 A * 4/1975 Eusemann ..... 52/311.2
4,970,754 A 11/1990 Anderson et al.
5,751,293 A * 5/1998 Hashimoto et al. ..... 345/588
5,959,362 A * 9/1999 Yoshino ..... 257/778
7,350,443 B2 * 4/2008 Oakey et al. ..... 83/13
8,145,345 B2 * 3/2012 Magee et al. ..... 700/131
2003/0037508 A1 * 2/2003 Kobayashi et al. ..... 52/747.11
2003/0118774 A1 6/2003 Tippett et al.
2005/0055976 A1 3/2005 Pacione
2006/0275578 A1 * 12/2006 Jones ..... 428/85

(Continued)

FOREIGN PATENT DOCUMENTS

GB 1 379 902 A 1/1975
JP 61-180838 11/1986

(Continued)

OTHER PUBLICATIONS

Ian Sharpe, "Tasteful tiling with Excel", retreived Mar. 27, 2013, archived at archive.org at least on Aug. 16, 2007, www.iansharpe.com/art_xltiling.php.*

(Continued)

*Primary Examiner* — Jacob Cigna

(74) *Attorney, Agent, or Firm* — Womble Carlyle Sandridge & Rice, LLP

(57) ABSTRACT

A method of manufacturing a modular textile system includes dividing a textile web into a plurality of frames that define carpet tiles to be formed from the textile web, providing each frame with an indicium, and forming the textile web into a plurality of carpet tiles. The indicium may include at least one of a variously oriented indicium and a variously positioned indicium for indicating the orientation of each carpet tile in an installation.

20 Claims, 5 Drawing Sheets

(56) References Cited

U.S. PATENT DOCUMENTS

| | | | | |
|---|---|---|---|---|
| 2007/0224420 | A1 | 9/2007 | Despins | |
| 2009/0032180 | A1* | 2/2009 | O'Connor | 156/249 |
| 2010/0086722 | A1* | 4/2010 | Barnes | 428/48 |

FOREIGN PATENT DOCUMENTS

| | | | |
|---|---|---|---|
| JP | 63-69510 | | 5/1988 |
| JP | 63-85173 | | 6/1988 |
| JP | 1-73244 | | 12/1989 |
| JP | 4-7460 | | 1/1992 |
| JP | 2005 127113 | A | 5/2005 |
| JP | 2009-095521 | A | 5/2009 |
| WO | WO 2007/146118 | A2 | 12/2007 |

OTHER PUBLICATIONS

International Search Report—PCT/US2010/036382.
Written Opinion—PCT/US2010/036382.
Japanese Office Action dated Jun. 24, 2014 in JP Appln. No. 2012-53992.

* cited by examiner

RANDOM TILE INSTALLATION USING NON-RANDOM INSTALLATION TECHNIQUE

CROSS-REFERENCE TO RELATED APPLICATIONS

This application is a continuation of PCT/US2010/036382, filed May 27, 2010, which claims the benefit of U.S. Provisional Application No. 61/182,807, filed Jun. 1, 2009, both of which are incorporated by reference herein in their entirety.

TECHNICAL FIELD

This disclosure is related to a method of making and installing floor coverings, for example, carpet tiles. This disclosure also is related to carpet tile systems and carpet tile installations.

BACKGROUND

Textile tiles, for example, carpet tiles, have been used in many floor covering applications due to their ease of installation. Traditionally, carpet tiles have been installed in a manner that seeks to mimic the appearance of a broadloom installation. Since carpet tiles are cut from a textile web, the tiles are typically installed monolithically, that is, with all of the tiles oriented in the same direction, usually the machine direction. To facilitate the installation, an indicium, for example, an arrow, may be printed on the back of each tile to indicate how the tiles should be oriented. The installer simply rotates each tile as needed so the arrows are pointing in the same direction.

Carpet tiles have also been designed with various patterns and designs that allow the tiles to be installed "randomly." As used herein, the term "random installation" generally refers to an installation technique in which each tile is oriented variably and indiscriminately with respect to an adjacent tile. For instance, in one exemplary random tile installation, the installer positions a first tile, and for each subsequent tile, the installer can choose one of four rotational positions (0, 90, 180, or 270 degrees) relative to the previous tile. After the tiles are arranged on the flooring surface, the installer is charged with reviewing the installation and reorienting any tiles that do not appear to have been laid randomly, based on the particular installer's perception. Unfortunately, by reconfiguring the tiles in this manner, some degree of true randomness of the installation is substituted by the judgment of the installer. Further, this step of reorienting tiles to create a more random "look" in the installer's view is both time-consuming and burdensome.

In some cases, the tiles may be provided with an arrow indicating the machine direction to assist the installer with rotating the tiles in a more "random" manner. However, if the installer focuses too much effort on trying to orient the arrows, and thereby the tiles, randomly, the installer may intentionally or inadvertently use a pattern of rotation, such that the resulting installation may not be random at all. Thus, there is a need for a method and system that provides a more truly random installation as compared with conventional tile systems, without placing a burden on the installer.

SUMMARY

This disclosure is directed generally to carpet tiles, a modular textile system including such tiles, and a textile installation that may be created using the modular tile system. This disclosure is also directed generally to a method of making and installing modular textiles, for example, carpet tiles, and a textile web from which the tiles may be formed.

In one aspect, each carpet tile of the modular textile system includes a variously positioned and/or variously oriented indicium. The position and/or orientation of the indicium may be random or may be pre-determined in a seemingly random or variable manner. Each carpet tile is installed such that each indicium is oriented in a uniform manner (i.e., identically oriented and/or positioned with respect to each other indicium). By arranging the variously positioned and/or variously oriented tiles in a like manner, the overall installation is random or at least seemingly random.

In another aspect, the method of this disclosure facilitates the creation of a random carpet tile installation (or an at least seemingly random carpet tile installation) using an organized or non-random installation technique. To do so, an arrow or other indicium is printed on the back of each carpet tile to indicate the configuration of the tile to be laid. The direction and/or placement of the indicium on a particular tile may be determined using a random number generator or using any other suitable method. When the tiles are installed, the installer rotates each tile until all of the indicia are oriented in a like manner (e.g., the arrows are unidirectional such that the arrow heads are pointing in the same direction), in a manner similar to a conventional monolithic installation. However, since the indicia are printed with various orientations or locations, the resulting tile installation includes variously oriented tiles. Thus, the installer need not be concerned with attempting to create a random installation because the unidirectional arrangement of the indicia will inherently result in a random installation.

Numerous variations of the method and system are contemplated. For example, although the method is described in connection with carpet tiles, the method may be used with other textile systems or flooring systems (e.g., hard surface flooring), or may be used in any other suitable manner.

Other features, aspects, and embodiments will be apparent from the following description and accompanying figures.

BRIEF DESCRIPTION OF THE DRAWINGS

The description refers to the accompanying schematic drawings, in which like reference characters refer to like parts throughout the several views, and in which.

DESCRIPTION

Figure 1A:
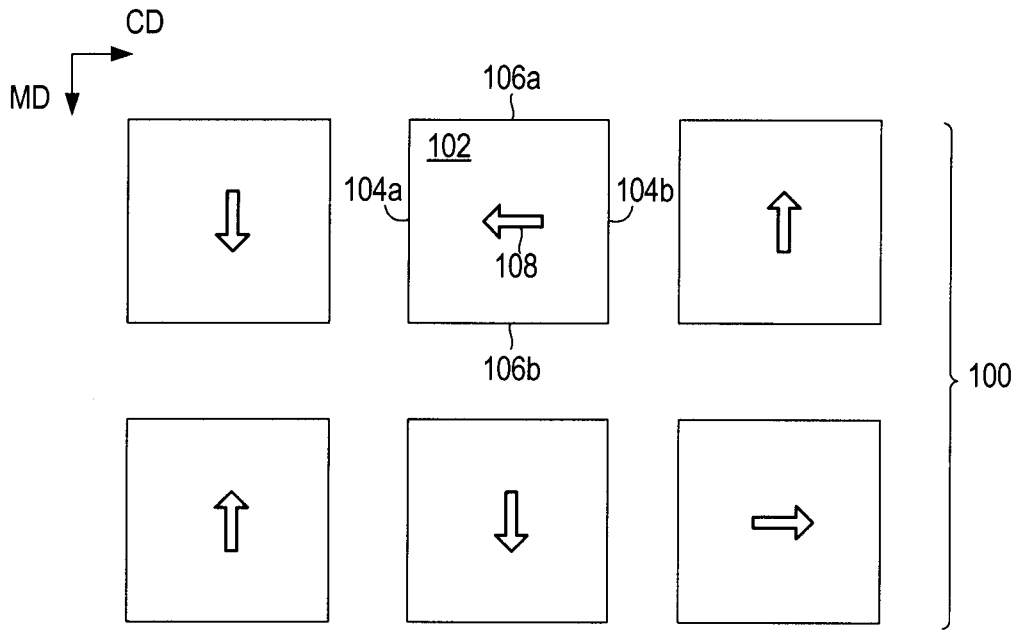
FIG. 1A schematically illustrates a modular textile system according to the disclosure.

FIG. 1A schematically illustrates an exemplary modular textile system 100. The modular textile system 100 includes a plurality of textile tiles 102 (only one of which is labeled), for example, carpet tiles, each of which includes a first pair of edges 104*a*, 104*b* that extend in a machine direction MD and a second pair of edges 106*a*, 106*b* that extend in a cross-machine direction CD, such that the carpet tiles 102 have a generally square shape. However, other shapes are contemplated. Each tile 102 includes a first or front side comprising fibers and a second or back side comprising a backing, as will be understood by those of skill in the art.

As shown in FIG. 1A, the back side of each carpet tile 102 includes an indicium 108 that is variously oriented with respect to the machine direction MD and cross-machine direction CD. The orientation of the indicium 108 may vary for each application. In one example, the indicium 108 may be oriented 0, 90, 180, or 270 degrees with respect to the machine direction MD, such that the indicium 108 is generally parallel and/or perpendicular to the various edges 104*a*, 104*b*, 106*a*, 106*b* of the carpet tile 102. In another example, the indicium 108 may be generally oblique to the various edges 104*a*, 104*b*, 106*a*, 106*b* of the carpet tile 102 (e.g., pointing towards the corners of the tile). Other possibilities are contemplated.

If desired, the orientation of each variously oriented indicium 108 may be provided randomly, for example, using a random number generator, as will be discussed further below. Alternatively, the orientation may be provided manually or otherwise in a predetermined, non-random, but variable manner (i.e., such that it is seemingly random).

The indicium 108 may generally comprise a directional indicium, i.e., a word, shape, symbol, mark, or other element that is asymmetrical along at least one line of symmetry, such that the direction and/or orientation of indicium 108 can be used to indicate an installation direction or orientation for the carpet tile 102. In this example, the indicium comprises an arrow. However, other possibilities are contemplated, as will be discussed further below in connection with FIGS. 3A and 3B.

Figure 1B:
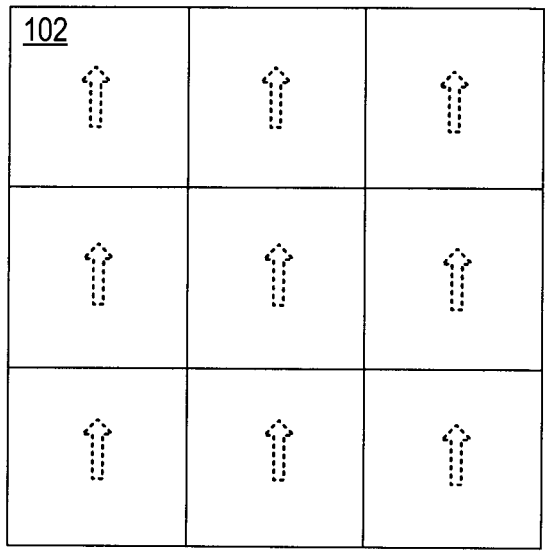
FIG. 1B schematically illustrates an exemplary installation using the modular textile system of FIG. 1A.

To use the carpet tiles 102 to create an installation on a flooring surface, each tile 102 may be rotated as needed so that the indicia 108 on the back of the tiles 102 are arranged in a unidirectional manner, for example, with the arrows 108 pointing in the same direction, and placed in an edge-to-edge relationship with one another, as shown, for example, in FIG. 1B (in which the arrows 108 on the back of the tiles 102 are hidden from view and shown with dashed lines). However, since the arrows 108 are oriented variously on the tiles 102, the resulting tile installation inherently includes an arrangement of variously oriented tiles. The tiles may be secured to the flooring surface in the conventional manner.

It will be understood that in any carpet tile installation, the relative positions of the carpet tiles 102 may be generally at the discretion of the installer. If desired, this "positional randomness" or "positional variability" may be minimized by instructing the installer to position the tiles in a sequential manner as the tiles 102 are removed from the packaging without regard to the installer's personal preferences.

Figure 1C:
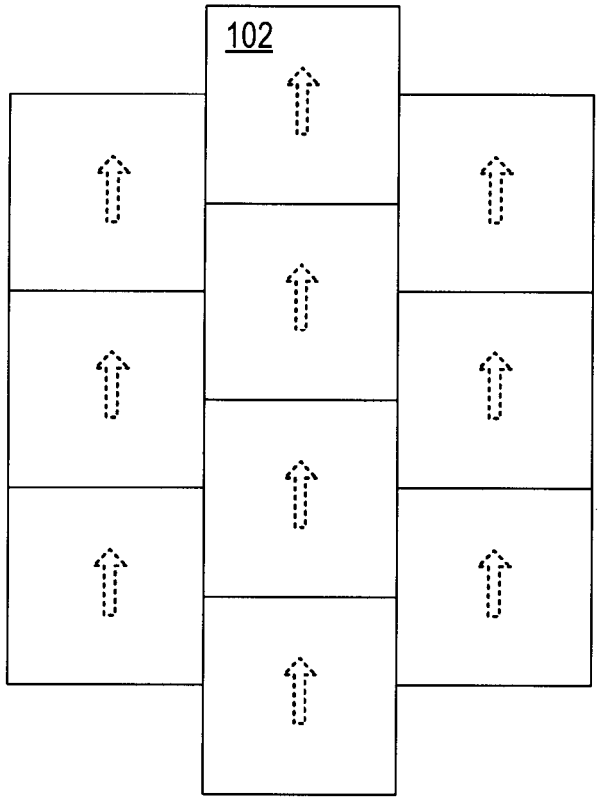
FIG. 1C schematically illustrates another exemplary installation using the modular textile system of FIG. 1A.
Figure 1D:
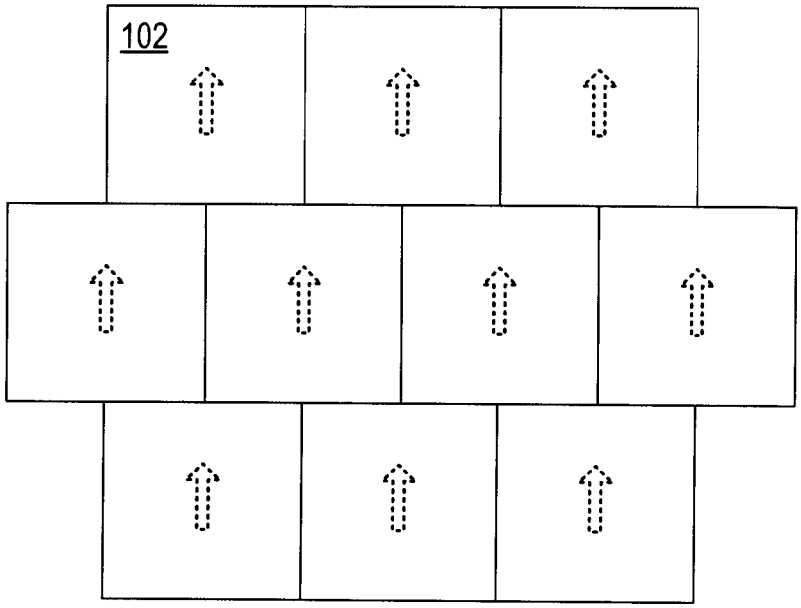
FIG. 1D schematically illustrates still another exemplary installation using the modular textile system of FIG. 1A.

It will also be appreciated that countless possible installation types or styles are contemplated. In FIG. 1B, the carpet tiles 102 are arranged in a unidirectional block configuration with the tile edges aligned with one another. In FIG. 1C, the carpet tiles 102 are arranged in a unidirectional ashlar configuration. In FIG. 1D, the carpet tiles 102 are arranged in a unidirectional brick configuration. Still other configurations may be used.

Figure 1E:
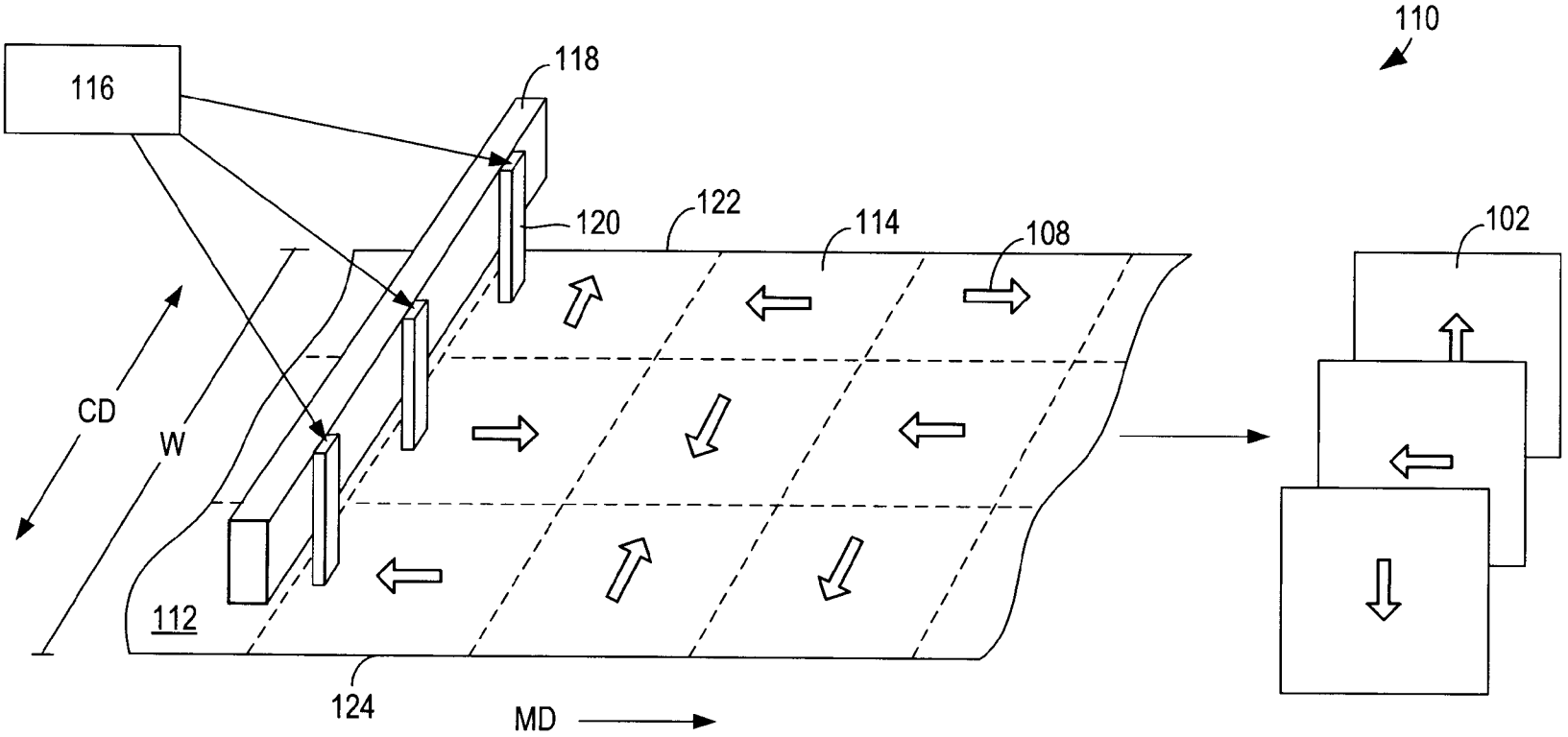
FIG. 1E schematically illustrates an exemplary process for forming the modular textile system of FIG. 1A.

FIG. 1E schematically illustrates an exemplary process 110 for forming the modular textile system 100 of FIG. 1A. A textile web 112 having a printable backing or back side may be divided into a plurality of smaller areas or frames 114 (e.g., cutting frames) (shown schematically with dashed lines), each of which defines a tile 102 to be cut from the web 112. In this example, the textile web 112 includes three substantially square shaped tile frames 114, each having a tile length and a tile width, across a width of the textile web 112 extending in the cross-machine direction CD. However, other shapes and numbers of frames may be used.

Each frame 114 may be provided with a variously oriented indicium 108 for facilitating installation of the tiles. As stated above, the orientation of the indicium may be random or may be seemingly random or variable.

For example, in one embodiment, as the textile web 112 advances in the machine direction MD, a random (or pseudo-random) number generator 116 may generate a plurality of orientation values, each of which represents a pre-determined orientation of an arrow or other indicium 108 to be printed on the back of the textile web 112 within the respective tile frame 114. For example, the orientation value may be an integer that corresponds to a 0, 90, 180, or 270 degree rotation of the printed indicium 108 relative to some predetermined point. Alternatively, the random number generator may be programmed to select from the values 0, 90, 180, or 270. Alternatively still, the orientation values may be determined manually or automatically using some other random or non-random technique. Still other possibilities are contemplated.

The orientation values may be sent to a printing unit or printer 118, which in this example, includes three independently operable print heads 120 generally facing the back side of the textile web 112. Each print head 120 may print the indicium 108 within the respective frame 114 based on the orientation value supplied by the random number generator 116.

Numerous orientation values and corresponding printing configurations are contemplated. In one particular example, an orientation value of 1 may correspond to a 0 degree position, such that the arrow is printed with the arrow head facing the respective print head 120. An orientation value of 2 may correspond to a 90 degree rotation with respect to the 0 degree position, such that the arrow is printed with the arrow head facing a first longitudinal edge 122 of the web 112. An orientation value of 3 may correspond to a 180 degree rotation with respect to the 0 degree position, such that the arrow is printed with the arrow head facing away from the respective print head 120, and an orientation value of 4 may correspond to a 270 degree rotation with respect to the 0 degree position, such that the arrow is printed with the arrow head facing a second longitudinal edge 124 of the web 112. In another example, the arrows may be directed towards the corners of the frames. Countless other variations may be used. Further, while arrows are used commonly in the textile industry, it will be understood that the indicium may be any word, number, symbol, or other image that is capable of being oriented with other indicia in a like manner, such that the indicium serves to indicate the installation direction.

In some embodiments, it may be desirable to ensure that an equal number of tiles having each rotation are produced from a particular web. To do so according to one example, the algorithm used to generate the orientation values may be adjusted to ensure that an equal number of orientation values are generated within a given total number of orientation values and/or length of textile web. Alternatively, the algorithm may require that after returning a particular value (e.g., "1"), that each other value (e.g., "2," "3," and "4") must be generated (in any order) before generating that value (e.g., "1") again. However, other methods are contemplated.

Any suitable printing technique and/or equipment may be used to print the indicia 108 on the textile web 112. In the exemplary process shown in FIG. 1E, at least one of the print heads 120 may be a digital printer (e.g., an ink jet or dot matrix print head). In another exemplary process 210 schematically illustrated in FIG. 2 (in which like reference numerals are used where appropriate, except that the "1" is replaced with a "2"), at least one print head 220 may be a transfer-type printer (e.g., flexographic, gravure, etc.). In such an embodiment, each print head 220 may index, pivot, or rotate independently to print the variously oriented indicium 208. Countless other possibilities are contemplated. Further, it will be understood that any number of printers, each containing one or more print heads, may be used as needed or desired.

Returning to FIG. 1E, after the arrow or other directional indicium 108 is printed within each tile frame 114, the textile web 112 can be cut to form a modular textile system 100 including a plurality of carpet tiles 102. The tiles 102 then may be processed in the conventional manner. In some instances, the tiles 102 may be packaged sequentially, such that some tiles cut from adjacent portions of the textile web 112 may be packaged together.

In other instances, the tiles 102 may be accumulated for later packaging. In such cases, the tiles 102 may be packaged indiscriminately, that is, without regard to their original position on the textile web 114, thereby introducing a further degree of randomness into the modular textile system and resulting installation.

Figure 3A:
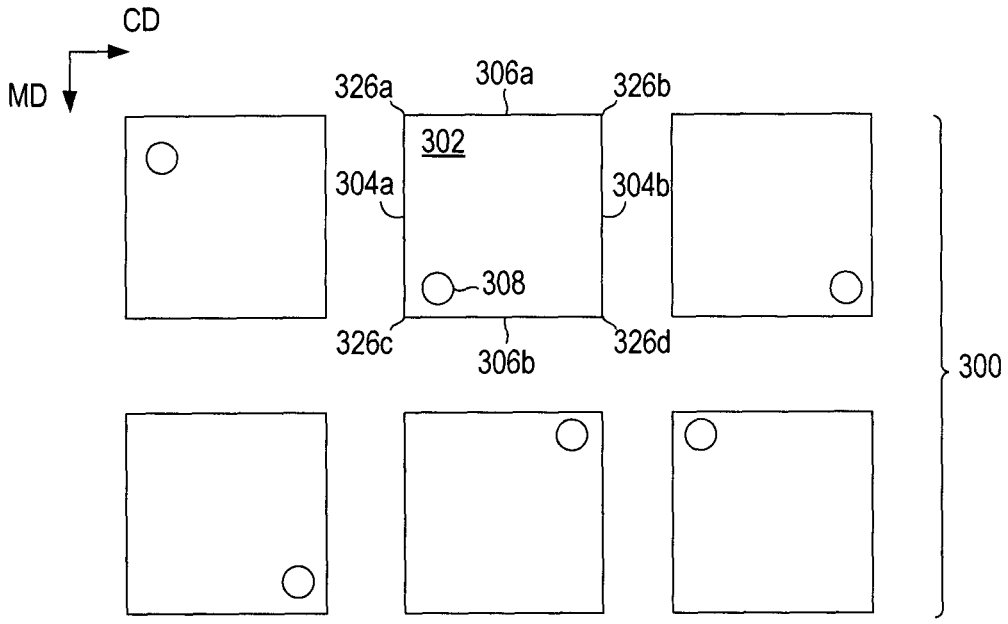
FIG. 3A schematically illustrates another modular textile system according to the disclosure.

FIG. 3A schematically depicts an exemplary variation of the system 100 of FIG. 1A. The modular textile system 300 includes features that are similar to the system 100 shown in FIG. 1A, except for variations noted and variations that will be understood by those of skill in the art. For simplicity, the reference numerals of similar features are preceded in the figures with a "3" instead of a "1."

In this example, the indicium 308 comprises a word, symbol, mark, or other element that is variously positioned on the back of the carpet tile 302, such that each indicium 308 is proximate to one of the edges 304*a*, 304*b*, 306*a*, 306*b* and/or corners 326*a*, 326*b*, 326*c*, 326*d* of the respective carpet tile. The indicia 308 may be symmetrical or asymmetrical since the position of the indicium 308 may be used to indicate the orientation of each tile 302. For example, in the illustrated embodiment 300, each indicium comprises a circle or dot 308 positioned adjacent to one of the corners 326 of each tile 302. In still another variation (not shown), the indicium may comprise a line or other marking proximate to one of the edges of each tile (e.g., perpendicular, parallel, or oblique to the respective edge). Countless other variations are contemplated hereby.

Figure 3B:
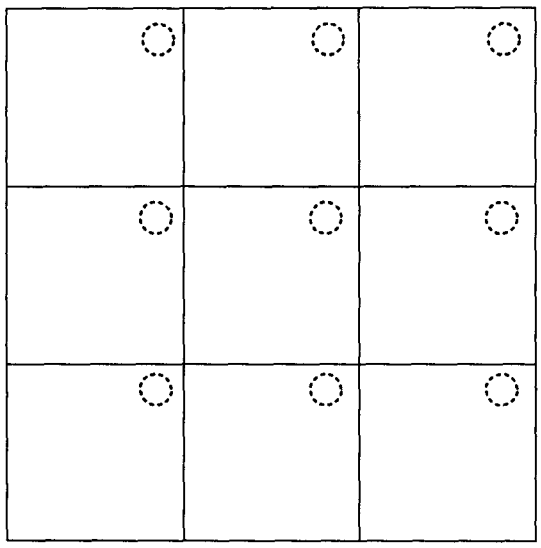
FIG. 3B schematically illustrates an exemplary installation using the modular textile system of FIG. 3A.

To install the tiles 302 according to one exemplary method, the tiles 302 may be oriented in a unidirectional manner such that the indicium 308 are similarly positioned with respect to one another, for example, as shown in FIG. 3B (in which the indicium 308 are hidden from view and shown with dashed lines).

Figure 2:
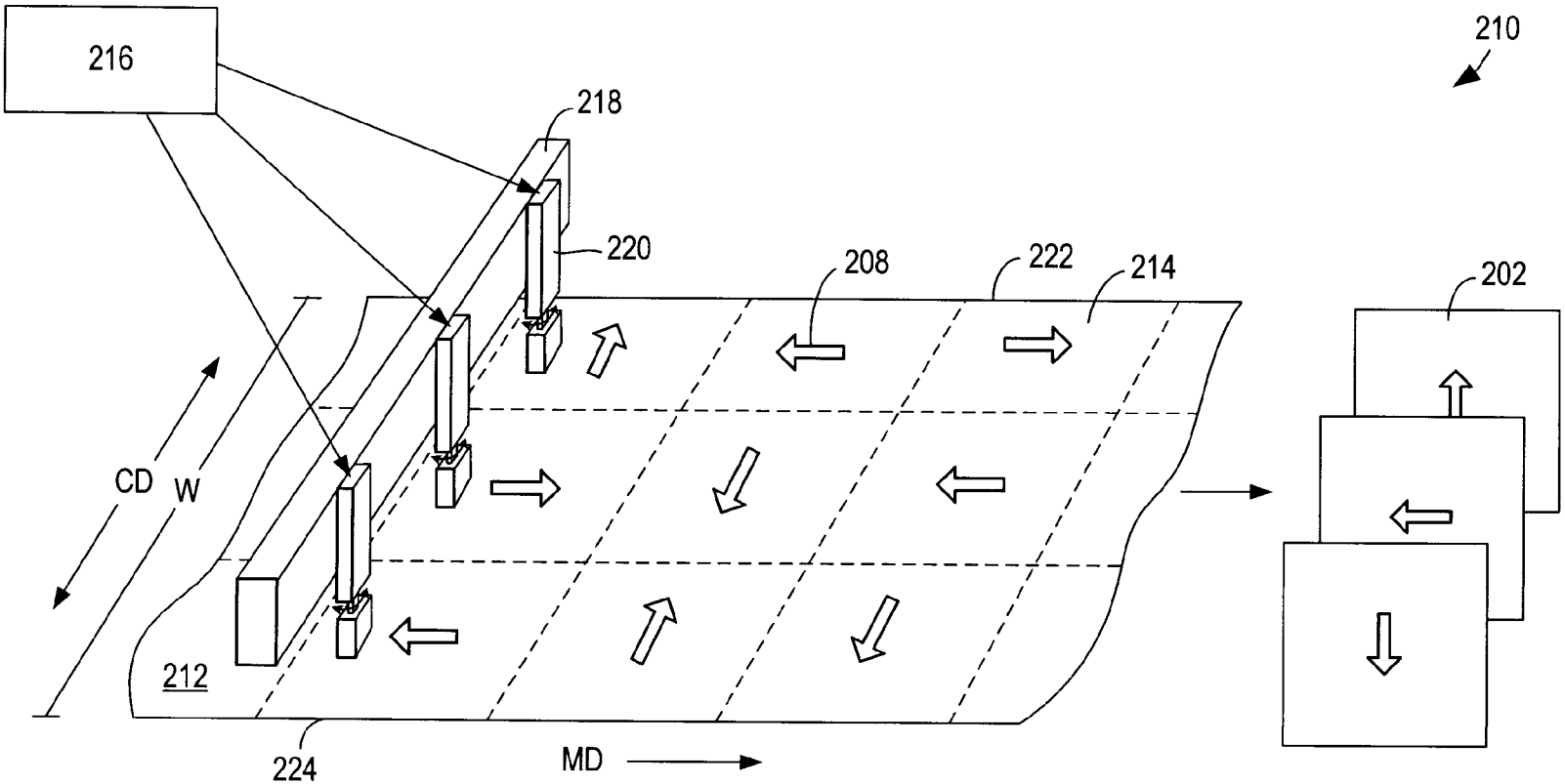
FIG. 2 schematically illustrates another exemplary process for forming a modular textile system.

The system 300 can be made as described in connection with FIGS. 1E and 2, or using any other suitable process, equipment, or technique. In this example, however, the values generated by a machine or manually may be referred to as position values, such that the indicium 308 is provided in a particular quadrant of the tile and/or adjacent to a particular corner of the respective tile frame 314. Numerous other possibilities are contemplated.

It will be appreciated that the present method and system greatly simplify the creation of a random tile installation. Unlike conventional systems, the installer need not adhere to complicated instructions for rotating the tiles with respect to one another to ensure some degree of variation in tile orientation. Further, the installer need not be burdened with the visual discretion and responsibility associated with conventional random tile systems. Instead, the carpet tiles may be positioned quickly and effortlessly as needed to arrange the indicia in a unidirectional configuration. Further, the present method and system ensure a greater degree of randomness in the resulting installation since the installer is not given the discretion to change the orientation of each tile to suit his particular preferences.

It will be readily understood by those persons skilled in the art that, in view of the above disclosure, the present invention is susceptible of broad utility and application. Although specific embodiments or aspects are disclosed, it will be understood that this disclosure is only illustrative and exemplary of the invention and is made merely for purposes of providing a full and enabling disclosure of the invention and to set forth the best mode of practicing the invention known to the inventors at the time the invention was made.

Many adaptations, variations, modifications, and equivalent arrangements will be apparent from or reasonably suggested by the present invention and the above detailed description thereof without departing from the substance or scope of the present invention. It will be recognized that various elements discussed with reference to the various embodiments may be interchanged to create entirely new embodiments coming within the scope of the invention. Accordingly, all matter contained in the above description or shown in the accompanying drawings shall be interpreted as illustrative only and is not intended nor is to be construed to limit or otherwise to exclude any such other embodiments, adaptations, variations, modifications, and equivalent arrangements of the present invention.

What is claimed is:

1. A method of manufacturing modular tiles, comprising:

cutting a textile web into modular tiles, wherein the textile web has a machine direction and a backing, wherein the backing of the modular tiles includes an indicium that is at least one of randomly oriented with respect to the machine direction of the textile web, and randomly positioned with respect to corners of the modular tiles, wherein the modular tiles are for being positioned in an edge-to-edge relationship with the indicia similarly configured with respect to one another, so that the modular tiles in the edge-to-edge relationship are randomly oriented with respect to one another.

2. A method of manufacturing modular tiles, comprising:

defining a plurality of areas of a textile web, the plurality of areas of the textile web comprising modular tiles to be cut from the textile web, wherein the textile web has a machine direction and a cross-machine direction, and wherein the textile comprises a backing;

marking the backing of the textile web within each area of the plurality of areas with an indicium that is at least one of randomly oriented with respect to the machine direction of the textile web, and randomly positioned within the area; and cutting the textile web into the modular tiles defined by the plurality of areas, wherein when the modular tiles are installed with the indicia of the modular tiles configured in a like manner with respect to one another, the installed modular tiles are randomly oriented with respect to one another.

3. A method of manufacturing modular tiles, comprising:

dividing a textile web into frames, the frames defining modular tiles for being cut from the textile web, wherein the textile web has a machine direction and a cross-machine direction, and wherein the textile web includes a backing;

marking the backing of the textile web within the frames with indicia that is at least one of randomly oriented with respect to the machine direction of the textile web, and randomly positioned within the frames; and cutting the textile web into the modular tiles defined by the frames, wherein the indicia are for indicating an installation direction of the modular tiles, wherein the modular tiles are for being installed with the indicia configured in a like manner with respect to one another, such that the at least one of randomly oriented indicia of the modular tiles are oriented in the same direction, and randomly positioned indicia of the modular tiles are in the same relative position, the installed modular tiles are randomly oriented with respect to one another.

4. A method of manufacturing modular tiles, comprising:

dividing a textile web into a plurality of frames, the plurality of frames defining modular tiles to be formed from the textile web, wherein the textile web includes a backing;

providing each frame of the plurality of frames with an indicium on the backing of the textile web, wherein the indicium comprises at least one of a randomly oriented indicium and a randomly positioned indicium; and forming the modular tiles from the textile web, wherein when the modular tiles are installed with the indicium of each modular tile configured in a like manner with respect to one another, such that the at least one of randomly oriented indicia of the modular tiles are oriented in the same direction, and randomly positioned indicia of the modular tiles are positioned in the same position with respect to one another, the installed modular tiles are randomly oriented with respect to one another.

5. The method of claim 4, wherein the textile web includes a first side including fibers and a second side opposite the first side, and providing each frame with the indicium comprises printing the indicium onto the second side of the textile web.

6. The method of claim 4, wherein dividing the textile web into a plurality of frames comprises dividing the textile web into a number of modular tile widths and lengths.

7. The method of claim 6, wherein each modular tile width and tile length defines one frame of the plurality of frames.

8. The method of claim 4, wherein the indicium is a randomly positioned indicium, and the method further comprises providing a plurality of positional values, wherein the positional values each correspond to a position of the indicium to be printed in each frame of the plurality of frames.

9. The method of claim 8, wherein providing the plurality of positional values comprises generating the plurality of positional values using a random number generator.

10. The method of claim 8, wherein providing the plurality of positional values comprises manually generating the plurality of positional values.

11. The method of claim 8, wherein the positional values each correspond to a corner of the respective frame.

12. The method of claim 8, wherein providing each frame with the indicium comprises printing the indicium onto the textile web in a position corresponding to the positional value for the respective frame.

13. The method of claim 4, wherein the indicium is a randomly oriented indicium, and the method further comprises providing a plurality of orientation values, wherein the plurality of orientation values each correspond to an orientation of the indicium to be printed in each frame of the plurality of frames.

14. The method of claim 13, wherein providing the plurality of orientation values comprises generating the plurality of orientation values using a random number generator.

15. The method of claim 13, wherein providing the plurality of orientation values comprises manually generating the plurality of orientation values.

16. The method of claim 13, wherein the orientation values each correspond to a 0, 90, 180, or 270 degree rotation of the indicium relative to an initial position.

17. The method of claim 13, wherein providing each frame with the indicium comprises printing the indicium onto the textile web in an orientation corresponding to the orientation value for the respective frame.

18. The method of claim 13, wherein the indicium comprises a directional indicium.

19. The method of claim 18, wherein the indicium comprises an arrow.

20. A method of manufacturing modular tiles, comprising:

dividing a textile web into a plurality of cutting frames, the cutting frames being for defining modular tiles to be cut from the textile web, wherein the textile web has a machine direction and wherein the textile web comprises a backing;

randomly generating a value for printing an indicium in each cutting frame of the plurality of cutting frames, the value comprising at least one of an orientation value, wherein the orientation value corresponds to an orientation of the indicium to be printed relative to the machine direction of the textile web, and a positional value, wherein the positional value corresponds to a position of the indicium to be printed within the frame;

printing the indicium on the backing of the textile web in each cutting frame of the plurality of cutting frames; and cutting the textile web into the modular tiles defined by the plurality of cutting frames, wherein the modular tiles are for being arranged in an edge-to-edge relationship with the indicia of the modular tiles configured in a like manner with respect to each other, so that the arranged modular tiles are randomly oriented with respect to one another.

* * * * *